US006415849B1

(12) United States Patent
Hohenbichler et al.

(10) Patent No.: US 6,415,849 B1
(45) Date of Patent: Jul. 9, 2002

(54) HOW TO AVOID CONTACT BETWEEN OXYGEN AND MOLTEN METAL

(75) Inventors: Gerald Hohenbichler, Kronstorf; Stefano Pellissetti, Linz, both of (AT); Romeo Capotosti, Narni; Guiseppe Guasto, Genoa, both of (IT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/367,434

(22) PCT Filed: Feb. 12, 1998

(86) PCT No.: PCT/EP98/00788

§ 371 (c)(1),
(2), (4) Date: Aug. 13, 1999

(87) PCT Pub. No.: WO98/35773

PCT Pub. Date: Aug. 20, 1998

(30) Foreign Application Priority Data

Feb. 14, 1997 (IT) ..... RM97A0082

(51) Int. Cl.[7] ..... B22D 11/00; B22D 11/06

(52) U.S. Cl. ..... 164/474; 164/253; 164/480; 164/428

(58) Field of Search ..... 164/479, 480, 164/481, 482, 429, 430, 431, 432, 433, 463, 423, 474, 253, 254

(56) References Cited

U.S. PATENT DOCUMENTS 3,920,062 A * 11/1975 Soykan et al. ..... 164/4
4,987,949 A 1/1991 Sakaguchi et al. ..... 164/450
5,535,812 A * 7/1996 Singleton ..... 164/479

FOREIGN PATENT DOCUMENTS

| | | | |
|---|---|---|---|
| DE | 2747061 | | 4/1979 |
| DE | 2831710 | | 10/1979 |
| DE | 2950406 | | 6/1981 |
| DE | 3602594 | | 7/1987 |
| EP | 0040072 | | 11/1981 |
| EP | 0430841 | | 6/1991 |
| EP | 0502344 | | 9/1992 |
| EP | 0526886 | | 2/1993 |
| EP | 0568211 | | 11/1993 |
| EP | 0714716 | | 6/1996 |
| JP | 60-40653 | * | 3/1985 |
| WO | 93/22087 | | 11/1993 |

* cited by examiner

*Primary Examiner*—Kuang Y. Lin
(74) *Attorney, Agent, or Firm*—Ostrolenk, Faber, Gerb & Soffen, LLP

(57) ABSTRACT

Method of preventing contact of oxygen with a metal melt during continuous casting, the metal melt flows into a casting chamber bounded by rolls and a hood and leaves this chamber as a stream. To completely prevent contact of oxygen with the metal melt and thus reoxidation, oxygen attempting to enter via any gaps between the walls and/or adhering to the walls is removed by suction applied at a succession of suction stages at the periphery of each roll before a gap between the hood and the roll at the top of the casting chamber. Inert gas may then flow to the rolls near the gap.

24 Claims, 2 Drawing Sheets

HOW TO AVOID CONTACT BETWEEN OXYGEN AND MOLTEN METAL

FIELD OF THE INVENTION

The invention relates to a method of preventing contact of oxygen with a metal melt during continuous casting, in which the metal melt flows into a casting chamber bounded by walls and leaves this chamber as a stream, and also an apparatus for implementing the method.

BACKGROUND OF THE INVENTION

In continuous casting, metal melt accumulates in the casting chamber and has to be protected against reoxidation and its bath surface has to be protected against high radiative heat loss. In conventional continuous casting, the bath surface is covered with casting powder or with an oil for this purpose.

For the casting of thin strips, various casting processes in which the casting chamber is formed not by rigid walls, but of a wall which moves with the stream or a plurality of walls which move with the stream, for example using a caterpillar chain as described in EP-A-0 526 886 or a roll as described in EP-A-0 568 211 or EP-B-0 040 072 or contrarotating casting rolls as described in U.S. Pat. No. 4,987,949 or EP-B-0 430 841, are known. In these methods, it is not possible to protect the metal melt reliably against reoxidation or heat loss by means of a casting powder or oil as is usually the case for casting chambers or casting dies having rigid walls.

EP-B-0 430 841 discloses, in the case of a two-roll casting unit, protecting the bath surface against excessively high radiative heat loss and against reoxidation by provision of a covering hood. However, for this solution it has been found that severe wear occurs at the contact surfaces between covering hood and casting rolls both on the covering hood and on the casting rolls and that, as a result of thermal deformation of the components, the entry of air and thus of oxygen through gaps between the walls bounding the casting chamber cannot be prevented. This results in reoxidation of the melt with all its disadvantages.

To minimize the entry of air through the gap between covering hood and casting rolls, U.S. Pat. No. 4,987,949 and EP-A-0 714 716 propose blowing an inert gas, preferably nitrogen or argon, into a defined gap between covering hood and casting rolls and thus to produce a barrier against intrusion of air. However, this measure is not sufficient to completely prevent air from entering the casting chamber and thus reaching the bath surface, so that, on the one hand, metal oxides are still formed at the bath surface and these lead to defects in the interior of the metal strip. On the other hand, metal oxides are formed at the surface of the solid shell forming around the stream or oxygen diffuses into the outer layer of the metal strip and there forms inclusions which increases the susceptibility to cracks. Despite the feeding-in of inert gas, air entrained in the microroughness of the roll surface is carried into the casting chamber in the laminar sublayer of the flow boundary layer. This sublayer adheres in the microroughness of the roll surface and can be stripped off neither by contacting, sliding seals nor by non-contact seals.

SUMMARY OF THE INVENTION

The invention makes it possible to avoid these disadvantages and difficulties and has the object of providing a method of the type described at the outset and an apparatus for continuous casting by means of which contact of oxygen with a metal melt can be prevented, which method and apparatus completely prevent reoxidation even when considerable wear occurs at the gaps between the walls forming the casting chamber. In particular, it should also be possible to remove the laminar sublayer of the air layer carried with or adhering to walls forming the casting chamber.

This object is achieved, in a method of the type described at the outset, by oxygen which attempts to enter via any gaps between the walls and/or is adhering to the walls being, removed by suction.

Particularly efficient removal of the oxygen can be advantageously achieved by carrying out the removal by suction in a plurality of extraction stages arranged behind one another from outside to inside towards the casting chamber, with the removal by suction advantageously occurring at a pressure which decreases from stage to stage from outside to inside towards the casting chamber.

Here, according to a preferred embodiment, the suction pressure in the extraction stage closest to the casting chamber is set to below 50 mbar, preferably below 10 mbar.

To ensure pressure equalization with the casting chamber, an inert gas is advantageously allowed to flow against the wall bounding the casting chamber directly adjacent to the extraction zone closest to the casting chamber, with the pressure of the inert gas advantageously being at least 10 mbar, preferably more than 200 mbar, above the pressure of the adjacent extraction stage.

Preferably, the inert gas is blown against the wall in a plurality of inert gas stages arranged next to one another from outside to inside towards the casting chamber.

The inert gas is advantageously blown onto the wall at a velocity of at least 0.5 m/s, not more than 10 m/s, preferably at more than 2 m/s.

In a casting process in which at least one wall is moved relative to the casting chamber, new regions of this wall which are about to enter the casting chamber are, according to a preferred embodiment, freed of adhering oxygen by removal of the oxygen by suction before entry. Continuous casting is then advantageously carried out by a roll casting process, preferably by a two-roll casting process, i.e. roll casting processes using only one casting roll, as described, for example, in EP-B-0 040 072, are also possibilities for application of the method of the invention. Of course, the method of the invention can also be applied in the casting of a metal melt on any moving cooling body, for example a caterpillar chain as described in DE-A-36 02 594. It is sometimes also advantageous for casting dies having rigid walls, e.g. if the application of a casting powder is not possible or would be too complicated.

An apparatus by means of which contact of oxygen with a metal melt can be prevented during continuous casting, in which a casting chamber bounded by walls is filled with metal melt and a stream leaves the casting chamber through a casting gap of the casting chamber, is characterized in that at any gaps present between adjacent walls there is provided an extraction device for oxygen attempting to enter via the gap and/or adhering to the walls.

In an apparatus for the continuous casting of a metal strip, preferably a steel strip, having two contrarotating casting rolls with parallel roll axes and two side dams which together form a casting chamber for accommodating molten metal and having a covering hood which is located above the casting chamber and closes off the latter at the top, and also having a sealing device which prevents entry of air into the casting chamber along a gap formed by the covering hood and the rotating casting rolls, the object of the invention is advantageously achieved by the sealing device being formed by at least one suction chamber, located on the atmosphere side in the vicinity of the gap between the rotating casting rolls and the covering hood and extending parallel to the roll axis.

This sealing device is particularly effective when it is made up of a plurality of suction chambers arranged next to one another in the circumferential direction of the casting rolls. Here, it is advantageous for each suction chamber to be connected via a suction line to an associated suction pump or a stage of a multistage suction pump. According to an embodiment which is simple in terms of construction, the sealing device is configured as a sequential multichamber system. As a result of this measure, the suction pressure decreases from suction chamber to suction chamber in the direction of motion of the casting rolls. Appropriate matching of the number of suction chambers to the circumferential speed of the casting rolls makes it possible to achieve complete removal of the air carried along with the rolls.

According to an improved embodiment, the sealing device is located at a defined distance from the casting roll surface and the gap formed by the sealing device and the casting roll surface is sealed, at least at the entry and exit sides, by means of contact seals, preferably brush seals or rubber lip seals. In this way, the entry of air is largely limited to the air carried along with the boundary layer even before the first suction chamber.

According to a further embodiment, at least one of the suction chambers is additionally equipped with an inert gas purge.

The apparatus is improved by locating an inert gas feed facility between the covering hood and the extraction device, with this inert gas feed facility being configured as a reduced pressure chamber having an opening directed toward the casting rolls. The opening is advantageously configured as a nozzle which is directed obliquely at the casting roll surface and is at an angle to the adjacent suction chamber. By means of this measure, an inert gas layer close to the roll is applied to the casting roll and excellent protection against access of oxygen or air is thus produced. If an inert gas layer of a few millimetres in thickness is applied to the casting roll and use is made of an inert gas which has a density higher than that of air, it is not necessary for the covering hood to directly adjoin the inert gas feed line and the extraction device.

BRIEF DESCRIPTION OF THE DRAWINGS

Further features and advantages may be seen from the following description of the apparatus and the method of casting a metal strip in a plurality of embodiments.

DETAILED DESCRIPTION OF THE DRAWINGS

Figure 1:
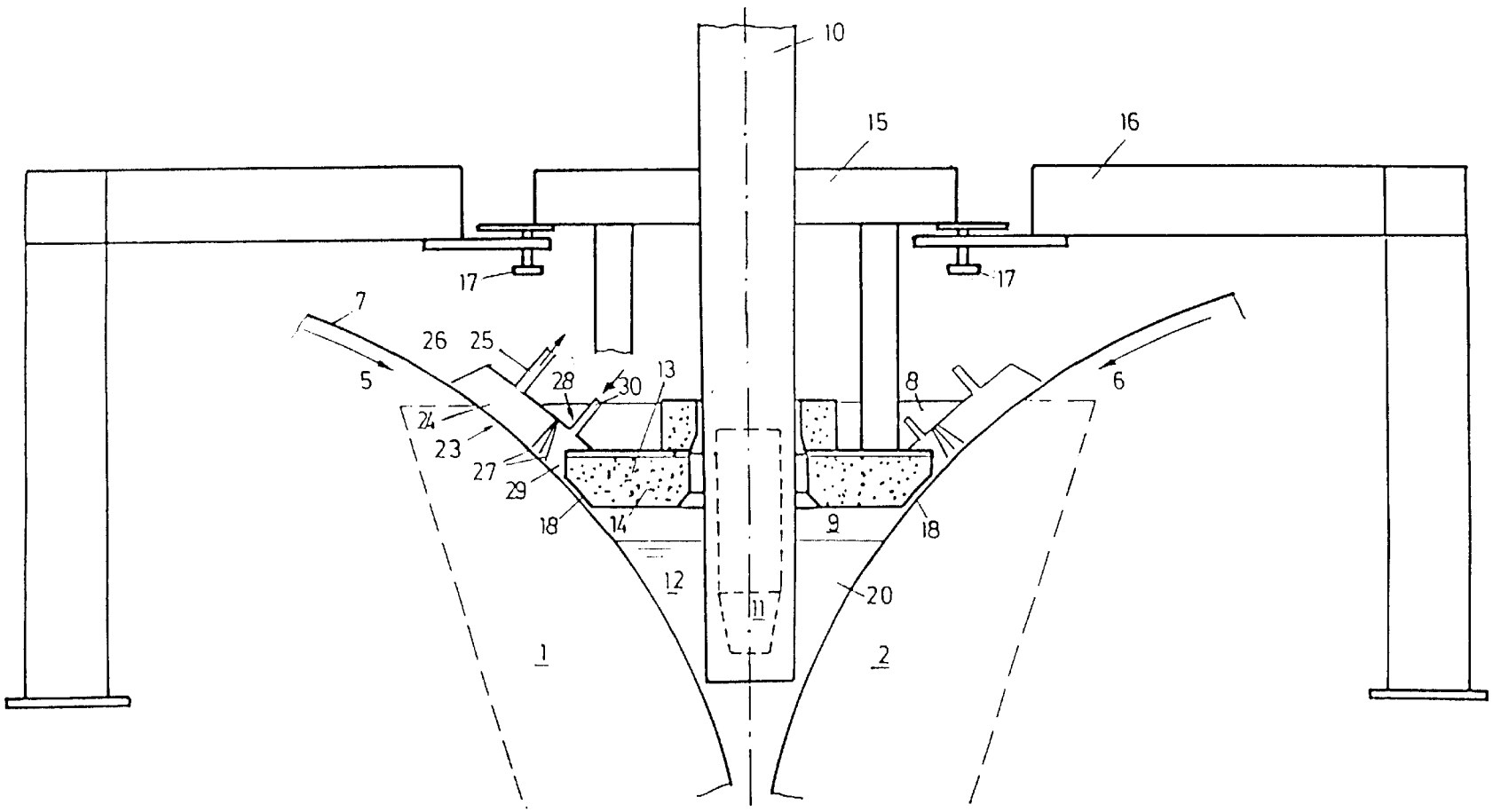
FIG. 1 shows a cross section through the two-roll casting plant with a sealing device according to a first embodiment.

The two-roll casting plant as is shown schematically in section in FIG. 1, has two powered casting rolls 1, 2 whose parallel roll axes 3, 4 are located in a horizontal plane. The two contrarotating, in the direction of the arrows 5, 6, casting rolls 1, 2 are provided with internal cooling (not shown) for the casting roll wall which forms the casting roll surface 7. At the end faces, side dams 8 are arranged sufficiently close to the casting rolls 1, 2. The casting rolls 1, 2 and the side dams 8 form a casting chamber 9 into which melt 20 is introduced from a melt container or distributor vessel (not shown) via a feed nozzle 10 provided with outlet openings 11, which melt 20 forms a melt pool 12. The casting chamber 9 is bounded at the top, relative to the casting rolls 1, 2 and relative to the side dams, by a covering hood 13 which has a refractory lining 14 on the melt side in order to protect the melt 20 from excessively large heat losses and against reoxidation by atmospheric oxygen. By means of a support device 15 for the covering hood 13, which is adjustable relative to a stationary frame 16 by means of adjusting elements 17, a desired minimum gap 18 between the covering hood 13 and the casting rolls 1, 2 is set. The covering hood 13 is penetrated by the feed nozzle 10, with a very small annular gap which is possibly covered by a seal, being provided between these two components.

Using a two-roll casting plant having this configuration, it is possible to cast a thin metal strip, in particular a steel strip having a thickness of from 1 mm to 12 mm, with the melt 20 to be cast being introduced continuously, as described above, into the casting chamber 9. At the contrarotating and cooled casting rolls 1, 2, there is increasing formation of stream shells which are, in the narrowest cross section between the casting rolls, joined to a strip shaped by the casting rolls. The thickness of the strip conveyed out by the casting rolls is determined by the spacing of the casting rolls.

To prevent entry of air into the casting chamber along a gap 18 formed by the covering hood 13 and the rotating casting rolls 1, 2, a sealing device 23 formed by a suction chamber 24 is located on the atmosphere side in the vicinity of the gap 18 and at a small distance from the casting roll surface 7. The suction chamber 24 is open in the direction of the casting roll surface 7 and is connected to a suction line 25 and a suction pump which is not shown. The suction chamber 24 is formed in a simple way by a U-profile which is open in the direction of the casting roll surface and extends parallel to the roll axis 3, 4 at a small distance from the casting roll surface over the entire length of the casting roll. The gap between suction chamber 24 and the casting roll surface 7 is covered by seals 27 which are fixed to the legs of the U-profile and contact the casting roll surface 7 and are preferably configured as brush seals or rubber lip seals.

Figure 2:
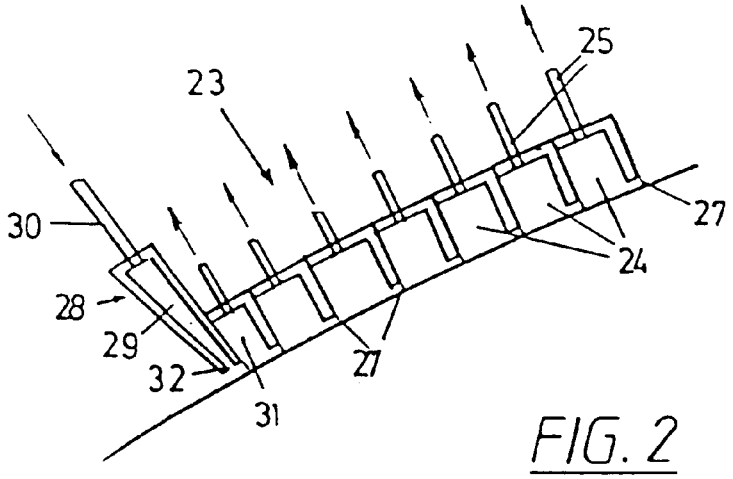
FIG. 2 shows a second embodiment of the sealing device according to the invention.

According to a further embodiment, as is shown in FIG. 2, the sealing device 23 is formed by a plurality of suction chambers 24 arranged next to one another in the circumferential direction of the casting rolls 1, 2 and each suction chamber is connected via an associated suction line 25 to, in each case, one stage of a multistage suction pump which is not shown. This sealing device 23 configured as a sequential multichamber system makes it possible to remove the introduced air in a plurality of extraction stages at a chamber pressure which decreases in stages in the direction of rotation of the casting rolls. The pressure of the last suction chamber 31 in the direction of rotation of the casting rolls is set to achieve optimum air extraction to a value of less than 50 mbar, preferably less than 10 mbar.

In the embodiment shown in FIG. 1, an inert gas feed facility 28 which is formed by a reduced pressure chamber 29 and has an opening 32 directed towards the casting roll surface is additionally arranged between the suction chamber 24 and the covering hood 13. In addition, it is connected to a feed line 30 for inert gas. In detail, the reduced pressure chamber 29 has the same construction as the suction chamber 24 and, to avoid erroneous entry of air, both are combined in a common construction unit. For the same reason, the reduced pressure chamber 29 is joined in an airtight manner to the covering hood 13.

In the embodiment shown in FIG. 2, the reduced pressure chamber 29 has an outlet opening directed towards the casting roll surface 7, with the reduced pressure chamber being combined with the sequential multichamber system of the sealing device 23 to form one construction unit and being sealed to prevent entry of air.

Inert gas is introduced into the reduced pressure chamber 29 in order to build up a flow boundary layer of inert gas on the casting roll surface 7. This inert gas is introduced in place of air into the casting chamber 9 through the gap 18 between the casting rolls 1, 2 and the covering hood 13. For this purpose, it is sufficient for the pressure in the reduced pressure chamber 29 to be set at a value at least 10 mbar, preferably more than 200 mbar, above the pressure of the previous extraction device 23.

Figure 3:
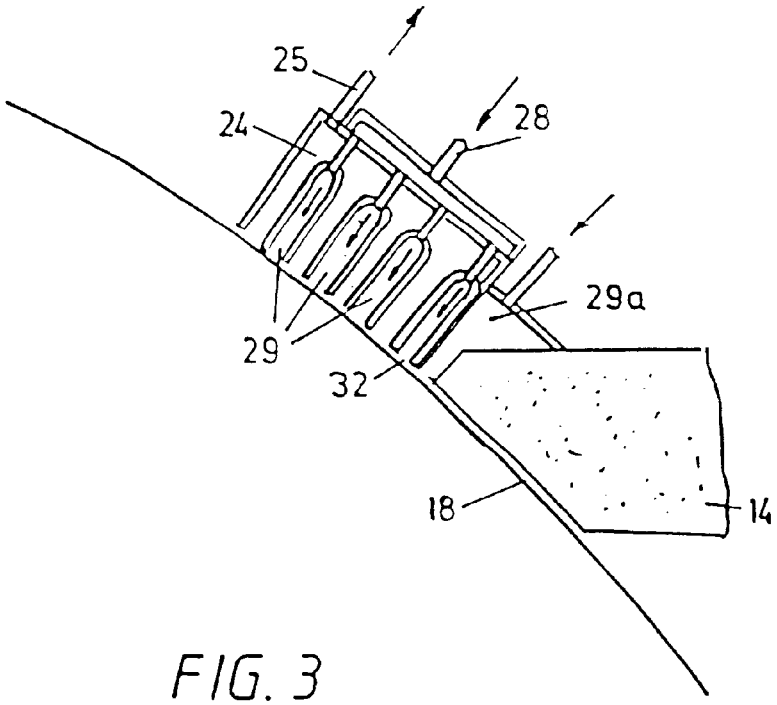
FIG. 3 shows a third embodiment of the sealing device according to the invention.

FIG. 3 shows an embodiment in which a plurality of reduced pressure chambers 29 which are connected to a common inert gas feed facility 28 are arranged within a suction chamber 24 for the extraction of fresh air connected to a suction line 25. In the reduced pressure chamber 29*a* which is the last in the direction of rotation of the casting rolls and is positioned directly before the covering hood 13, the inert gas pressure is, in contrast to the preceding reduced pressure chambers 29, set to a value above atmospheric pressure.

Final residues of atmospheric oxygen adhering to the casting roll surface 7 in the boundary layer can be removed by means of the inert gas purge, if the inert gas is blown directly against the casting roll surface 7, for which purpose the flow velocity is set to at least 0.5 m/s, preferably more than 2 m/s. Flow velocities of more than 10 m/s bring no additional effect.

What is claimed is:

1. A method of preventing contact of oxygen with a metal melt during continuous casting wherein the method is performed using a casting chamber bounded by walls and the casting chamber being disposed above two rolls positioned to form a nip through the which the metal melt from the casting chamber will pass, and the casting chamber being further defined by a hood extending above the casting chamber toward the peripheries of the two rolls upstream of the nip and the hood being sized and shaped to define a gap between the hood and each of the rolls, the method comprising:

flowing a metal melt into the casting chamber below the hood; rotating the rolls so that their peripheries form a nip and evacuating a stream of metal melt from the casting chamber through the nip;

extracting by suction of air at the peripheries of the rolls at a plurality of extraction stages in a row around the periphery of each roll leading up to the hood and the gap between the hood and the rolls for preventing oxygen from entering the casting chamber through the gap.

2. The method of claim 1, wherein the plurality of extraction stages at each roll are in a sequence toward the casting chamber.

3. The method of claim 2, wherein the suction pressure decreases from extraction stage to stage along a direction toward the casting chamber.

4. The method of claim 3, wherein the suction pressure in the extraction stage closest to the casting chamber is below 50 mbar.

5. The method of claim 3, wherein the suction pressure in the extraction stage closest to the casting chamber is below 10 mbar.

6. The method of claim 1, further comprising flowing inert gas against a roll of the casting chamber wherein the inert gas flow is adjacent to the extraction stage that is closest to the hood outside of the hood.

7. The method of claim 6, wherein the inert gas is flowed under a pressure that is at least 10 mbar above the pressure of the adjacent extraction stage.

8. The method of claim 6, wherein the inert gas is flowed under a pressure that is at least 200 mbar above the pressure of the adjacent extraction stage.

9. The method of claim 6, wherein the inert gas is blown against the peripheries of the rolls over a plurality of inert-gas flowing stages arranged one after the other from outside toward the casting chamber.

10. The method of claim 6, wherein the inert gas is blown onto the peripheries of the rolls at a velocity of between 0.5 and 10 m/s.

11. The method of claim 6, wherein the inert gas is blown onto the peripheries of the rolls at a velocity greater than 2 m/s.

12. The method of claim 11, further comprising rating the rolls relative to the casting chamber so that as new periphery regions of the rolls are about to enter the casting chamber, the suction pressure applied to the rolls removes oxygen by suction prior to entry of the rolls into the casting chamber.

13. Apparatus for continuous casting of a metal strip comprising first and second parallel, counter rotating casting rolls positioned to define a nip between them through which a metal stream may pass and two side dams at the ends of the rolls forming with the rolls a casting chamber for accommodating molten metal;

a covering hood located above and defining the top of the casting chamber, the hood extending toward the peripheries of the two casting rolls but being spaced from the rolls to form a respective gap between the hood and each of the rolls wherein metal melt is supplied to the casting chamber and exits through the nip between the rolls;

an oxygen extraction device for preventing the passage of oxygen through the gap and into the casting chamber, the extraction device comprising at each roll a plurality of suction chambers in a row around the periphery of the roll and upstream of the hood and the casting chamber with respect to a direction of rotation of the roll through the nip, the suction chambers extending around the circumference of the roll from outside the hood toward the hood and the casting chamber, the suction chamber being operative for drawing off oxygen and preventing the entry of air into the casting chamber through the gap.

14. An apparatus of claim 13, further comprising respective suction lines connected to each of the suction stages at each of the rolls for supplying a series of suctions to the peripheries of the rolls moving toward the gap.

15. The apparatus of claim 14, wherein the suction chambers define a multi-chamber sequential suction applying system at each of the rolls and extending toward the covering hood.

16. The apparatus of claim 15, wherein the multi-chamber system at each roll is at a gap distance from the surface of the roll, and sealing devices between the multi-chamber system and the surface of the roll across the gap distance, and the sealing devices are at least upstream entry and downstream exit sides of the passage of the roll past the multi-chamber system.

17. The apparatus of claim 16, wherein the seals are brush seals or rubber lip seals.

18. The apparatus of claim 15 wherein at least one of the suction chambers of the multi-chamber system has an inert gas purge.

19. The apparatus of claim 18, wherein the inert gas purge comprises an inert gas feed facility between the hood and the suction chamber.

20. The apparatus of claim 19, wherein the inert gas feed facility comprises a reduced pressure chamber having an opening directed toward each of the roll peripheries.

21. The apparatus of claim 20, wherein the opening for the inert gas feed facility comprises a nozzle directed obliquely at the roll surface and at an angle adjacent to the suction chamber.

22. The apparatus of claim 13, further comprising a lamellar seal located between the suction chamber and the covering hood.

23. Apparatus for continuous casting comprising:

two rolls rotatable about parallel axes and opposing to one another so that the two rolls form a nip;

an elongated hood extending between the two rolls such that the elongated hood and the two rolls form a casting chamber located upstream of the nip and receiving a metal melt which flows through the nip, the elongated hood terminating at a radial distance from the two rolls such that each roll and the elongated hood form a respective gasp therebetween;

suction chambers arranged in two rows each of which extends along a circumference of a respective one of the two rolls and is located upstream of the respective gap; and a suction pressure source for generating a pressure sufficient to remove oxygen from the suction chambers and distributed therebetween so that a pressure created in an upstream suction chamber of each row differs from a pressure in a downstream suction chamber of the same row.

24. The apparatus defined in claim 23, further comprising an adjusting element for displacing the hood and the rolls relative to one another to adjust the gaps to a desirable minimum dimension.

* * * * *